US006030170A

United States Patent [19]

Lewis

[11] Patent Number: 6,030,170

[45] Date of Patent: Feb. 29, 2000

[54] HYDRAULIC LIFT BOOM ATTACHABLE TO A TRACTOR'S DRAW BAR AND THREE POINT HITCH

[76] Inventor: Steve B. Lewis, 10621 Douglas Rd., Grand Bay, Ala. 36541

[21] Appl. No.: 09/055,862

[22] Filed: Apr. 6, 1998

[51] Int. Cl.[7] ..... B66F 9/00

[52] U.S. Cl. ..... 414/703; 212/202; 212/204

[58] Field of Search ..... 414/703, 680; 212/201, 202, 204

[56] References Cited

U.S. PATENT DOCUMENTS

| | | | |
|---|---|---|---|
| 2,804,979 | 9/1957 | Lassiter | 212/202 X |
| 3,940,000 | 2/1976 | Mousel . | |
| 4,067,471 | 1/1978 | Roatcap | 414/703 |
| 4,068,774 | 1/1978 | Howell, Jr. . | |
| 4,345,871 | 8/1982 | Kalif | 414/703 |
| 4,394,107 | 7/1983 | Siebert | 414/631 |
| 5,129,775 | 7/1992 | Coats et al. | 414/24.5 |
| 5,195,726 | 3/1993 | Kaner | 212/202 X |

*Primary Examiner*—Donald W. Underwood
*Attorney, Agent, or Firm*—Joseph N. Breaux

[57] ABSTRACT

The hydraulic lift boom attachment including a support frame and a telescopic lifting arm wherein the support frame is coupled to a tractor's three point hitch which hydraulically raises or lowers the support frame. The telescopic lifting arm has one end coupled to the support frame and the other end is coupled to the tractor's draw bar via a pulley assembly to rotate such other end of the telescopic lifting arm when the support frame is hydraulically raised or lowered. Furthermore, the support frame of the hydraulic lift boom attachment includes a telescopic vertical support assembly to vary the vertical height of the telescopic lifting arm.

5 Claims, 2 Drawing Sheets

HYDRAULIC LIFT BOOM ATTACHABLE TO A TRACTOR'S DRAW BAR AND THREE POINT HITCH

TECHNICAL FIELD

The present invention relates to an attachment for tractors such as hydraulic lifts and in particular relates to a hydraulic lift boom attachment including a support frame and a telescopic lifting arm wherein the support frame is coupled to a tractor's three point hitch which hydraulically raises or lowers the support frame. The telescopic lifting arm has one end coupled to the support frame and the other end is coupled to the tractor's draw bar via a pulley assembly to rotate such other end of the telescopic lifting arm when the support frame is hydraulically raised or lowered. Furthermore, the support frame of the hydraulic lift boom attachment includes a telescopic vertical support assembly to vary the vertical height of the telescopic lifting arm.

BACKGROUND OF THE INVENTION

Tractors are used for performing a variety of tasks by attaching to the rear of the tractor a myriad of implements such as used for ploughing, cultivating and lifting. There are numerous implement designs for carrying out the desired tasks. More specifically, the lifting implements for tractors used to handle and lift heavy loads have been designed to attach to the three point hitch of a tractor. In other instance, the lifting implements are attached to the draw bar. However, the lifting implements having lifting arms or booms typically require an independent source of hydraulic power to raise and lower the lifting arm. Therefore, known hydraulic lifting implements are complex in structure and costly to purchase for the individual user or small farm owners. Moreover, the independent source of hydraulic power in some instance connects to the tractor's hydraulic system. Henceforth, the hydraulic lifting implements are not easily attached and detached to the tractor.

For example, U.S. Pat. No. 3,940,000, issued Feb. 24, 1976 to Mousel, entitled "UNIVERSAL HYDRAULIC LIFT ATTACHMENT FOR TRACTORS" discloses a hydraulic lift system having an independent piston detachably connected to the hydraulic system of a tractor. The frame is primarily supported by the tractor's draw bar.

U.S. Pat. No. 4,067,471, issued Jan. 10, 1978 to Roatcap, entitled "THREE POINT TRACTOR HITCH BOOM ATTACHMENT" discloses a tractor hitch boom attachment utilizing the conventional three point hitch mounting mechanism. The boom is rotated within an arc via an actuator means.

U.S. Pat. No. 5,129,7115, issued Jul. 14, 1992 to Coats et al., entitled "BALE HANDLING APPARATUS" discloses a bale handling apparatus for attaching to a tractor specifically for handling, moving, and manipulating large cylindrical hay hales.

U.S. Pat. No. 4,068,774, issued Jan. 17, 1978 to Howell, Jr., entitled "MATERIAL HANDLING IMPLEMENT" discloses an implement for carrying and handling materials mountable to a conventional tractor three point hitch.

U.S. Pat. No. 4,394,107, issued Jul. 19, 1983 to Siebert, entitled "TRACTOR MOUNTED FORKLIFT" discloses a forklift attachment for tractors having a three point hitch.

U.S. Pat. No. 4,345,871, issued Aug. 24, 1982 to Kalif, entitled "HIGH-LIFT ATTACHMENT FOR AN AGRICULTURAL TRACTOR PROVIDED WITH A THREE-POINT LINKAGE" discloses a tractor-lift attachment utilizing a platform and frame for mounting to a conventional three point tractor hitch.

While each of the above prior lifting device function as desired, none of the above device utilize both the tractor's three point hitch and the tractors draw bar wherein the tractor's draw bar is utilized to rotate the telescopic lifting arm via a pulley assembly. Furthermore, the above devices do not provide a hydraulic lift boom attachment having a support frame which includes a telescopic vertical support assembly to vary the vertical height of the telescopic lifting arm independent from the pivotal rotation to raise or lower the telescopic lifting arm.

As can be appreciated, the telescopic vertical support assembly in combination with the utilization of both the tractor's three point hitch and the tractors draw bar allows the overall vertical lifting height to be maximized while providing a hydraulic lift boom attachment which is sturdy and structurally relatively simple.

As will be seen more fully below, the present invention is substantially different in structure, methodology and approach from that of the prior hydraulic lift attachments.

SUMMARY OF THE INVENTION

The preferred embodiment of the hydraulic lift boom of the present invention solves the aforementioned problems in a straight forward and simple manner. What is provided is a hydraulic lift boom attachment including a support frame and a telescopic lifting arm wherein the support frame is coupled to a tractor's three point hitch which hydraulically raises or lowers the support frame. The telescopic lifting arm has one end coupled to the support frame and the other end is coupled to the tractor's draw bar via a pulley assembly to rotate such other end of the telescopic lifting arm when the support frame is hydraulically raised or lowered. Furthermore, the support frame of the hydraulic lift boom attachment includes a telescopic vertical support assembly to vary the vertical height of the telescopic lifting arm.

The present invention provides a useful accessory for the farmer, agriculturalist or other tractor owner to facilitate in the handling and lifting of heavy loads of material.

The hydraulic lift boom attachment of the present invention is used with a three point rear hitch and draw bar of a tractor. The hydraulic lift boom attachment comprises: a support frame attachable to said three point hitch wherein the three point hitch hydraulically raises or lowers said support frame; a lifting arm having one end coupled to said support frame and the other end has a nosepiece; and, a pulley assembly, coupled to said support frame, having a pair of roller guides coupled to said support frame and a looped cable attachable to said draw bar wherein said cable detachably couples to said nosepiece of said lifting arm.

In operation, as the support frame is raised a pulling force is exerted on the cable via the draw bar to rotate said other end of said lifting arm since the draw bar is stationary.

The support frame comprises: a base attachable to two point couplings of said three point hitch; a telescopic vertical support assembly perpendicularly coupled to said base wherein said telescopic vertical support assembly selectively varies a vertical height of a telescopic lifting arm having one end pivotally coupled thereto; an attachment means, coupled to a rear side of said telescopic vertical support assembly, for coupling a third coupling of said the three point hitch to said support frame; a first reinforcement limb coupled to said base and one side of said telescopic vertical support assembly; and, a second reinforcement limb coupled to said base and the other side of said telescopic vertical support assembly.

The telescopic vertical support assembly comprises: a vertical support member having formed therein first and second spaced guide rails; and, first and second parallel support flanges, slidably coupled in said first and second spaced guide rails, respectively wherein each of said first and second parallel support flanges has formed therein a plurality of holes and wherein said one end of said lifting arm is selectively pivotally attached to said first and second support flanges via a selected hole pair to selectively vary a height of said lifting arm and wherein a height of said first and second support flanges is capable of being automatically slidingly raised or lowered along said first and second spaced guide rails.

In view of the above, an object of the present invention is to provide a hydraulic lifting boom attachment which is attachable to the rear three point hitch of a tractor and wherein the telescopic lifting arm or boom is rotated via a pulley assembly as the support frame is raised.

Another object of the present invention is to provide a hydraulic lifting boom attachment including a telescopic lifting arm or boom which is coupled to a telescopic vertical support assembly to vertically adjust the telescopic lifting arm or boom, thus giving the boom versatility to accommodate the height of the load of material being lifted. Furthermore, the telescopic feature of the telescopic lifting arm or boom provides the necessary versatility to allow the telescopic lifting arm to be positioned above the load of material in close proximity to the center of gravity of such load of material.

A further object of the present invention is to provide a hydraulic lift boom attachment which includes a pulley assembly having a cable made of a non-resilient material having high tensile strength, and flexibility. The cable attaches to the draw bar of the tractor, and to a nosepiece of the telescopic lifting arm. As the support frame is raised, the draw bar exerts a pulling force to rotate the telescopic lifting arm to lift objects or other heavy loads of material by pulling the cable. The cable extends over roller guides or pulleys at the top of the support frame.

More specifically, as the support frame is hydraulically raised via the hydraulic power of the three point hitch, the vertical height of the telescopic lifting arm is raised and, simultaneously, as the support frame is hydraulically raised, the vertical height of the telescopic lifting arm is rotated upward via the pulley assembly.

Additionally, the vertical height of the telescopic lifting arm can be raised or lowered via the telescopic feature of the telescopic vertical support assembly of the support frame. Thereby, the telescopic vertical support assembly in combination with the utilization of both the tractor's three point hitch and the tractor's draw bar allows the overall vertical lifting height of the hydraulic lifting boom attachment to be maximized with ample versatility.

It is a still further object of the present invention to provide a hydraulic lift boom attachment for tractors having a three point hitch coupling and a cable coupled to a pulley assembly for coupling the pulley assembly to a tractor's draw bar.

It is a still further object of the invention to provide a variable length and variable height lifting arm.

In view of the above objects, it is a feature of the present invention to provide a hydraulic lift boom attachment for the purposes described which is inexpensive, dependable and fully effective in accomplishing its intended purposes.

Another feature of the present invention is to provide a hydraulic lift boom attachment which is easily attached and detached to the tractor's three point hitch and draw bar.

A further feature of the present invention is to provide a hydraulic lift boom attachment which is relatively simple structurally. provide a hydraulic lift boom attachment which is simple and inexpensive to manufacture.

It is a still further feature of the present invention to provide a hydraulic lift boom attachment which is easy to use.

The above and other objects and features of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
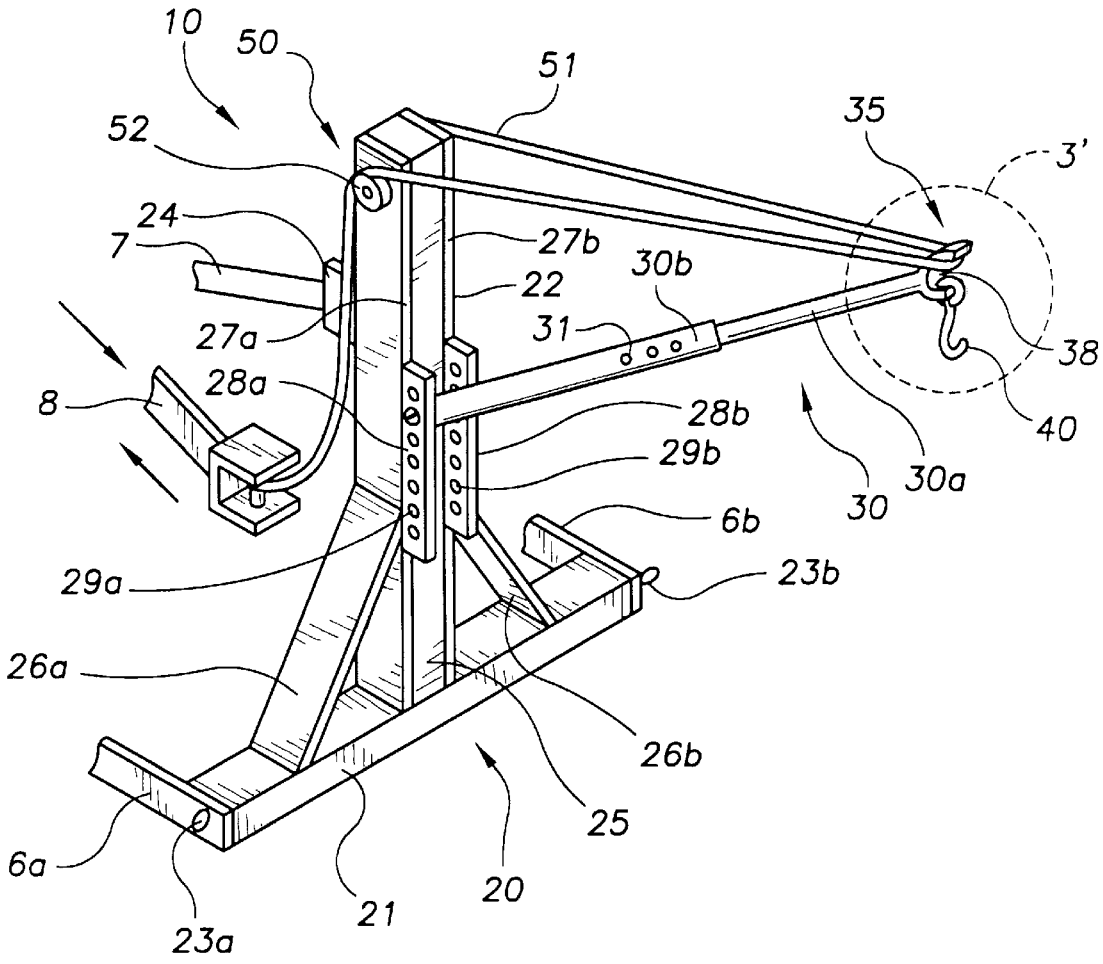
FIG. 1 is a perspective view of the hydraulic lift boom attachment of the preferred embodiment of the present invention.
Figure 2:
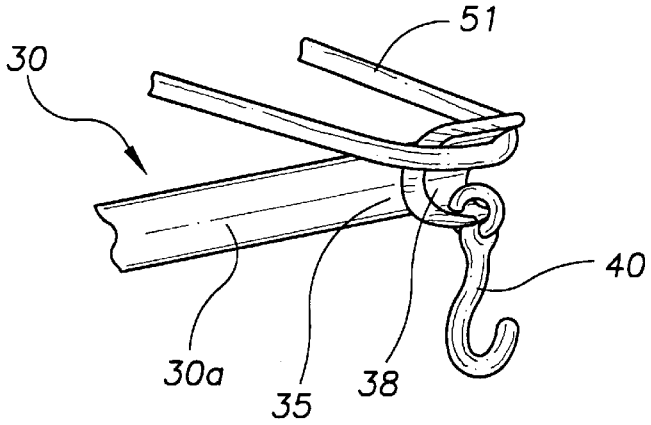
FIG. 2 is a enlarged partial view of the second end of the telescopic lifting arm or boom as seen in circle 3' of FIG. 1; and, FIG. 3 is a side elevational view of the present invention.
Figure 3:
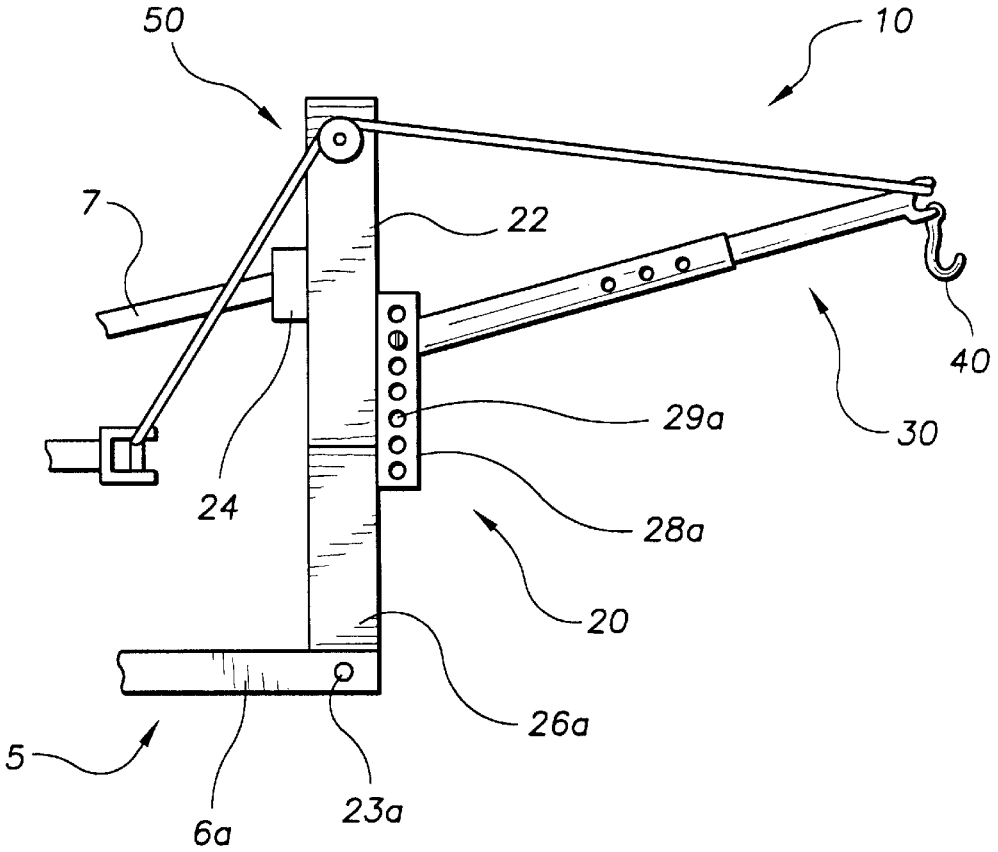

The present invention is a hydraulic lift boom attachment for use on tractors and other like agriculture vehicles. As seen in the accompanying FIGS. 1–3, hydraulic lift boom attachment 10 provides an accessory having many uses in the field of agriculture or other industrial environments which provide the user the ability to lift heavy objects to heights up to 12 feet or higher. In operation hydraulic lift boom attachment 10 is attached to the rear of a tractor (not shown). In this manner, hydraulic lift boom attachment 10 is attached to a conventional three point hitch 5 found on nearly every current tractor model. The conventional three point hitch 5 has three couplings fixed to the rear frame of a tractor. The first two couplings 6*a* and 6*b* of the three point hitch 5 are positioned on a lowermost portion of the tractor's frame. The third coupling 7 of the three point hitch 5 is generally vertically displaced above the first two; the three points forming a triangle. The three point hitch 5 swings vertically by means of connection to a hydraulic operating unit of the tractor which is well known. The hydraulic operation of the three point hitch 5 is actuated by the operator via the tractor's controls (not shown).

Hydraulic lifting boom attachment 10 comprises support frame 20, telescopic lifting arm or boom 30, lifting hook 40, and pulley assembly 50.

Support frame 20 comprises a rigid base 21, sliding vertical support assembly 22 and reinforcement limbs 26*a* and 26*b*. Rigid base 21, a horizontal bar, couples support frame 20 to the lower two points 6*a* and 6*b* of the three point hitch 5 via attachment means 23*a* and 23*b* wherein a respective one of the lower two points 6*a* and 6*b* are coupled to a respective end of the rigid base 21. A third attachment means 24 (see FIGS. 1 & 3) is coupled to the rear side of sliding vertical support assembly 22 for coupling the third coupling 7 of the three point hitch 5 to support frame 20.

Sliding vertical support assembly 22 is the main support of the telescopic lifting arm or boom 30 of the hydraulic lift boom attachment 10 wherein sliding vertical support assembly 22 rotatably supports telescopic lifting arm or boom 30 and allows telescopic lifting arm or boom 30 to be manually adjusted vertically. Sliding vertical support assembly 22 comprises a vertical support member 25 having formed therein first and second spaced guide rails 27*a* and 27*b*.

The vertical support member 25 of sliding vertical support assembly 22 is rigidly coupled perpendicularly to rigid base 21 wherein a respective one of the reinforcement limbs 26*a* and 26*b* is coupled to a respective side of the vertical support member 25 to stabilize vertically vertical support member 25.

Sliding vertical support assembly 22 further comprises first and second parallel support flanges 28*a* and 28*b* slidably coupled in first and second spaced guide rails 27*a* and 27*b*, respectively. The first support flange 28*a* and the second support flange 28*b* have formed therein a first plurality of holes 29*a* and a second plurality of holes 29*b*, respectively, wherein each hole of the first plurality of holes 29*a* and a respective hole of the second plurality of holes 29*b* are aligned. A first end of telescopic lifting arm or boom 30 is pivotally attached to first and second support flanges 28*a* and 28*b* by a pin (not shown) that passes through respective aligned holes 29*a* and 29*b* of first and second parallel support flanges 28*a* and 28*b*.

As can be appreciated, the size or height of the load hoisted by telescopic lifting arm or boom 30 is accommodated by the relative positioning of the first end of telescopic lifting arm or boom 30 in accordance with the aligned holes 29*a* and 29*b* of first and second support flanges 28*a* and 28*b*. Moreover, first and second support flanges 28*a* and 28*b* slide upward in first and second spaced guide rails 27*a* and 27*b*, respectively, to further automatically vary the vertical height of telescopic lifting arm or boom 30 as telescopic lifting arm or boom 30 is rotatingly lifted via pulley assembly 50. Thereby, the overall lifting height of the hydraulic lift boom attachment 10 can be maximized by adjusting the relative vertical height positioning of the first end of telescopic lifting arm or boom 30 and wherein the sliding vertical support assembly 22 further automatically varies the vertical height during operation of the hydraulic lift boom attachment 10

Pulley assembly 50 comprises cable 51 and a pair of roller guides or pulleys 52 wherein each roller guide or pulley of the pair of roller guides or pulleys 52 is coupled o the top portion of a respective side of the vertical support member 25. In operation, cable 51 is guided over the top end of the telescopic lifting arm or boom 30 and to draw bar 8 of the tractor via the pair of roller guides or pulleys 52. Cable 51 may comprise a flexible inelastic endless loop of material wherein such material may comprise such materials as steel cable, Kevlar® cord, nylon cord or chains. When cable 51 is a chain, intermeshing sprockets are the preferred arrangement. It is apparent, that cable 51 is formed of a material which has high tensile strength and durability, yet retains a non-resilient flexible state.

The draw bar 8 of the tractor provides the necessary pulling forces to pull cable 51 when support frame 20 is raised via the three point hitch 5. When support frame 20 is raised, the draw bar 8 of the tractor is stationary and provides a pulling force on cable 51 in the direction of ARROW 1 to raise the nosepiece 38 of telescopic lifting arm or boom 30. When the support frame 20 is lowered, draw bar 8 of the tractor releases the pulling force on pulling cable 51, in the direction of ARROW 2, so that the nosepiece 38 of telescopic lifting arm or boom 30 is pivotally lowered.

Telescopic lifting arm or boom 30 is variable in length. Telescopic lifting arm or boom 30 comprises at least two sections 30*a* and 30*b* that are slidably or telescopingly engaged. In the preferred embodiment, there are two sections 31*a* and 30*b*. First section 30*a* has formed therein a plurality of holes 31. Second section 30*b* is slidably received in first section 30*a* and also has formed therein a plurality of holes (not shown) wherein a respective hole of second section 30*b* is capable of being aligned with a respective hole of the plurality of soles 31 of first section 30*a*. A locking pin (not shown) is placed in the aligned holes of the first and second sections 30*a* and 30*b* for holding the length of telescopic lifting arm or boom 30 at the selected length.

First section 30*a* has one end pivotally coupled to first and second support flanges 28*a* and 28*b* by the pin (not shown). Such one end of first section 30*a* is said first end of telescopic lifting arm or boom 30.

The second end 35 of telescopic lifting arm or boom 30 has a lifting hook 40 that is pivotally carried by said second end 35. Nevertheless, lifting hook 40 may be coupled to one end of a cord wherein the other end of the cord would be coupled to the second end 35 of telescopic lifting arm or boom 30. In addition, the second end 35 of telescopic lifting arm or boom 30 has a coupler or nosepiece 38. The nosepiece 38 releasably holds cable 51 for rotating telescopic lifting arm or boom 30 as cable 51 is pulled.

As can be appreciated, telescopic lifting arm or boom 30 coupled to sliding vertical support assembles 22 to vertically adjust the height of telescopic lifting arm or, boom 30 provides versatility to accommodate the height of the load of material being lifted. Furthermore, the telescopic feature of the telescopic lifting arm or boom 30 provides the necessary versatility to allow the telescopic lifting arm or boom 30 to be positioned above the load of material in close proximity to the center of gravity of such load of material.

In operation, support frame 20 is coupled to the three point hitch 5 and cable 51 is coupled to nosepiece 38 of telescopic lifting arm or boom 30. After, the hydraulic lift boom attachment 10 is installed, the height of the load of material or object should be assessed to manually adjust the height of telescopic lifting arm or boom 30 and the length of telescopic lifting arm or boom 30.

The telescopic lifting arm or boom 30 is raised by hydraulically raising support frame 20 via the hydraulic power of the three point hitch 5. As can be appreciate, as support frame 20 is raised, the vertical height of the telescopic lifting arm is raised and, simultaneously, as the support frame 20 is hydraulically raised, the vertical height of the telescopic lifting arm is rotated upward via the pulley assembly 50, since the draw bar 8 is stationary.

Additionally, the vertical height of telescopic lifting arm or boom 30 can be raised or lowered via the telescopic feature of sliding vertical support assembly 22 of support frame 20. Thereby, sliding vertical support assembly 22 in combination with the utilization of both the tractor's three point hitch 5 and the tractor's draw bar 8 allows the overall vertical lifting height of the hydraulic lifting boom attachment 10 to be maximized with ample versatility.

The uniqueness of the construction of the present invention and the versatility it presents in the art is unsurpassed by the prior lifting devices. The hydraulic lift boom attachment 10 provides an accessory attachable to any three point hitch of a tractor and the draw bar 8, or similar vehicle, for accomplishing numerous tasks from lifting hay bales to transport heavy machinery.

It is noted that the embodiment of the hydraulic lift boom attachment described herein in detail, for exemplary purposes, is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A lift boom attachment for use with a three point rear hitch and a draw bar of a tractor, said attachment comprising:

a support frame attachable to said three point hitch wherein the three point hitch raises or lowers said support frame;

a lifting arm having one end rotatably coupled to said support frame and the other end having a nosepiece; and, a pulley assembly, coupled to said support frame, having a pair of pulleys coupled to said support frame and a looped cable, attachable to said draw bar, and extends over said pair of pulleys wherein said cable detachably couples to said nosepiece of said lifting arm and wherein as said support frame is raised a pulling force is exerted on said cable via said draw bar to rotate said other end of said lifting arm upward.

2. The attachment of claim 1, wherein said lifting arm comprises first and second sections which are telescopingly coupled together to selectively vary a length of said lifting arm.

3. The attachment of claim 1, wherein each pulley of said pair of pulleys is coupled to a top portion of a respective side of a vertical member of said support frame.

4. The attachment of claim 1, further comprising a lifting hook coupled to said other end of said lifting arm.

5. The attachment of claim 1, wherein said cable comprises an endless loop of a high tensile strength material.

* * * * *